US008545318B2

(12) United States Patent
Carson, Jr. et al.

(10) Patent No.: US 8,545,318 B2
(45) Date of Patent: Oct. 1, 2013

(54) GAMING MACHINE SECURITY INTERFACE MODULE

(75) Inventors: Robert H. Carson, Jr., Reno, NV (US); Franco E. Crivelli, Reno, NV (US)

(73) Assignee: IGT, Reno, NV (US)

( * ) Notice: Subject to any disclaimer, the term of this patent is extended or adjusted under 35 U.S.C. 154(b) by 0 days.

(21) Appl. No.: 13/372,919

(22) Filed: Feb. 14, 2012

(65) Prior Publication Data

US 2012/0142412 A1 Jun. 7, 2012

Related U.S. Application Data

(62) Division of application No. 12/412,096, filed on Mar. 26, 2009, now Pat. No. 8,142,290.

(51) Int. Cl.
*A63F 9/24* (2006.01)

(52) U.S. Cl.
USPC ..... 463/29; 463/42

(58) Field of Classification Search
USPC ..... 463/42, 29
See application file for complete search history.

(56) References Cited

U.S. PATENT DOCUMENTS

| | | | | |
|---|---|---|---|---|
| 4,259,720 | A * | 3/1981 | Campbell | 705/71 |
| 5,655,961 | A | 8/1997 | Acres et al. | |
| 5,923,249 | A * | 7/1999 | Muir | 340/545.1 |
| 6,272,475 | B1 * | 8/2001 | Nolte et al. | 705/43 |
| 6,575,833 | B1 * | 6/2003 | Stockdale | 463/29 |
| 7,047,338 | B1 | 5/2006 | Nguyen et al. | |
| 8,142,290 | B2 | 3/2012 | Carson et al. | |
| 2002/0116615 | A1 * | 8/2002 | Nguyen et al. | 713/168 |
| 2002/0142831 | A1 | 10/2002 | Mattice et al. | |
| 2007/0178970 | A1 | 8/2007 | LeMay et al. | |

FOREIGN PATENT DOCUMENTS

| | | |
|---|---|---|
| JP | 2001-340611 | 12/2001 |
| JP | 2002-171284 | 6/2002 |
| JP | 2004-180956 | 7/2004 |

OTHER PUBLICATIONS

U.S. Notice of Allowance dated Jan. 6, 2012 issued in U.S. Appl. No. 12/412,096.
U.S. Third Party Submission dated Aug. 7, 2012 issued in U.S. Appl. No. 13/272,922.
U.S. Notice of Allowance dated Nov. 21, 2011 issued in U.S. Appl. No. 12,412,096.

* cited by examiner

*Primary Examiner* — Yu-Hsi D Sun
(74) *Attorney, Agent, or Firm* — Foley & Lardner LLP

(57) ABSTRACT

A gaming machine includes an electronic gaming module which includes a game controller, and also includes a separate security interface module which monitors door switches and various devices. The security interface module has a separate unswitched power supply and also has a separate communication connection with a backend system so that it can continue to communicate with a backend system even when the electronic gaming module is powered down.

17 Claims, 6 Drawing Sheets

GAMING MACHINE SECURITY INTERFACE MODULE

CROSS-REFERENCE TO RELATED APPLICATIONS

This application is a divisional of U.S. patent application Ser. No. 12/412,096, entitled "GAMING MACHINE SECURITY INTERFACE MODULE", filed Mar. 26, 2009, which is incorporated herein by reference.

BACKGROUND OF THE INVENTION

This invention relates to security systems for wager-based gaming machines such as slot machines or video poker machines.

A wide variety of devices can be used as components of a wager-based gaming machine such as a slot machine or video poker machine. Some examples of these devices are lights, coupon dispensers, card readers, bill validators, coin acceptors, coin hoppers, display panels, key pads, and gaming controllers. Many of these devices are built into the gaming machine while some are grouped into separate modules such as top boxes which may be placed on top of the machine.

Some gaming machine devices are considered more critical to the gaming machine operations than others. In particular, devices that control the input and output of money from the gaming machine are generally considered critical devices. The gaming controller, which controls the features of the game played on the gaming machine including the pay-out of a particular game as well as the gaming devices which output game pay-outs, is one of the most critical gaming devices, if not the most critical device. Specific examples of other critical devices include card readers, bill validators, ticket coupon readers, and coin acceptors which control the input of money into the gaming machine and note stackers, token dispensers, drop boxes and ticket/coupon dispensers which control the output of money from the gaming machine.

Access to a particular gaming machine device depends on the type of device. Input devices such as bill validators, coin acceptors, and card readers or output devices such as coupon dispensers or token dispensers are directly accessible. These devices have at least one access mechanism on the outside of the gaming machine so that the gaming machine may either accept money or indicia of credits from players desiring to play the game or pay-out money to a player playing a game. However, access to the mechanisms controlling the operation of these devices is usually behind one or more doors provided on the gaming machine exterior. The gaming controller and the money storage devices such as bill stackers and drop boxes are less accessible. These devices are usually only accessible after opening one or more doors or other barriers which limit access to these critical devices.

The doors which allow access to the critical devices are often secured with keyed locks. For security, when any of these doors are opened, the gaming machine stops normal game play operation and switches to an attention state. Thus, it is necessary to detect whether a door is open or closed via an electronic means so that the operating software utilized by the gaming controller can take appropriate action.

Another access mechanism to gaming devices including bill validators, coin acceptors, token dispensers, gaming controllers, and coupon dispensers is through wires which accept and transmit signals which control the operation of the device. Typically, during the operation of the gaming machine, many of the associated gaming devices are controlled in some manner by the gaming controller located within the gaming machine. The control of a gaming device is enabled by the wires which connect a gaming device to the gaming controller. For example, when a player is playing a game and receives a pay-out during the course of a game, the gaming controller may send out a signal to a coupon dispenser, located in some other part of the gaming machine away from the gaming controller, instructing the coupon dispenser to dispense a coupon representing the pay-out. Thus, access may be gained to a gaming device, via the wires connected to the gaming device.

A common mode of theft for gaming machines involves accessing the devices which control the input and output of money to the gaming machine through some access mechanism and manipulating the devices in some manner to obtain an illegal pay-out. For example, one type of theft might involve simply taking money from a drop box while a gaming machine is being accessed for maintenance. Another type of theft might involve illegally gaining access to the gaming controller and reprogramming the gaming controller to pay-out an illegal jack pot. Another type of theft might involve compromising the wires to a coupon dispenser and sending a signal instructing it to dispense coupons with some monetary value.

One method for preventing theft is installing a security system which monitors the various access mechanisms of a gaming machine. Typically, security systems of this type monitor access to the various entry ports within the gaming machine as well as the wires to some gaming devices. The security system monitors access to the entry port by sending out signals to sensors able to detect whether access to the entry port has occurred. Usually, the entry port contains a sensor device that forms some type of closed circuit when the entry port is closed and an open circuit when the entry port is open.

Security monitoring of access to the gaming machine is usually implemented in some manner by the gaming controller during normal operations of the gaming machine in conjunction with some security monitoring hardware independent of the gaming controller. The security monitoring by the gaming controller is implemented while the gaming machine is receiving power from an external power source such as AC power from a power outlet. However, when such power is turned off, security monitoring may cease, providing opportunities for theft or other interference.

In one arrangement, a security monitoring system that is separate from the gaming controller stores data regarding security events (such as a door opening) even when the gaming controller is powered down. When an entry port is opened, some information regarding this event is stored by the security monitoring system. For example, the security monitoring system might store information regarding whether a particular entry port was accessed during a particular period of time. This information can later be used to determine when a theft has occurred or when tampering with the gaming machine has occurred. However, such recorded information does not generally help to detect security breaches in real-time.

SUMMARY

A wager-based gaming machine according to an embodiment of the present invention includes a security interface module which provides security monitoring even when power is switched off to other portions of the gaming machine. Such a security interface module has a network connection that allows it to independently continue to communicate with a backend system. The security interface module may be located in a secure enclosure to limit access.

A networked electronic wager-based gaming machine according to an embodiment of the present invention includes an electronic gaming module that has a first connection to a data network, the electronic gaming module receiving power over a first power connection that includes a power switch; and a security interface module that has a second connection to the data network, the security interface module receiving power over a second power connection that does not include the power switch so that the security interface module receives power independently of the power switch.

A method of operating a networked wager-based gaming machine according to an embodiment of the present invention includes the steps of performing one or more security functions in an electronic gaming module, the electronic gaming module connected to a data network by a first data connection; monitoring power provided to the electronic gaming module; and in response to detecting a loss of power to the electronic gaming module, performing the one or more security functions in a security interface module, the security interface module connected to the data network by a second data connection, the security interface module receiving power separately from the electronic gaming module.

A networked electronic wager-based gaming machine according to an embodiment of the present invention includes means for performing one or more security functions in an electronic gaming module, the electronic gaming module connected to a data network by a first data connection; means for monitoring power provided to the electronic gaming module; and means for performing the one or more security functions in a security interface module, the security interface module connected to the data network by a second data connection, the security interface module receiving power separately from the electronic gaming machine.

BRIEF DESCRIPTION

DETAILED DESCRIPTION OF ILLUSTRATED EMBODIMENTS

Figure 1:
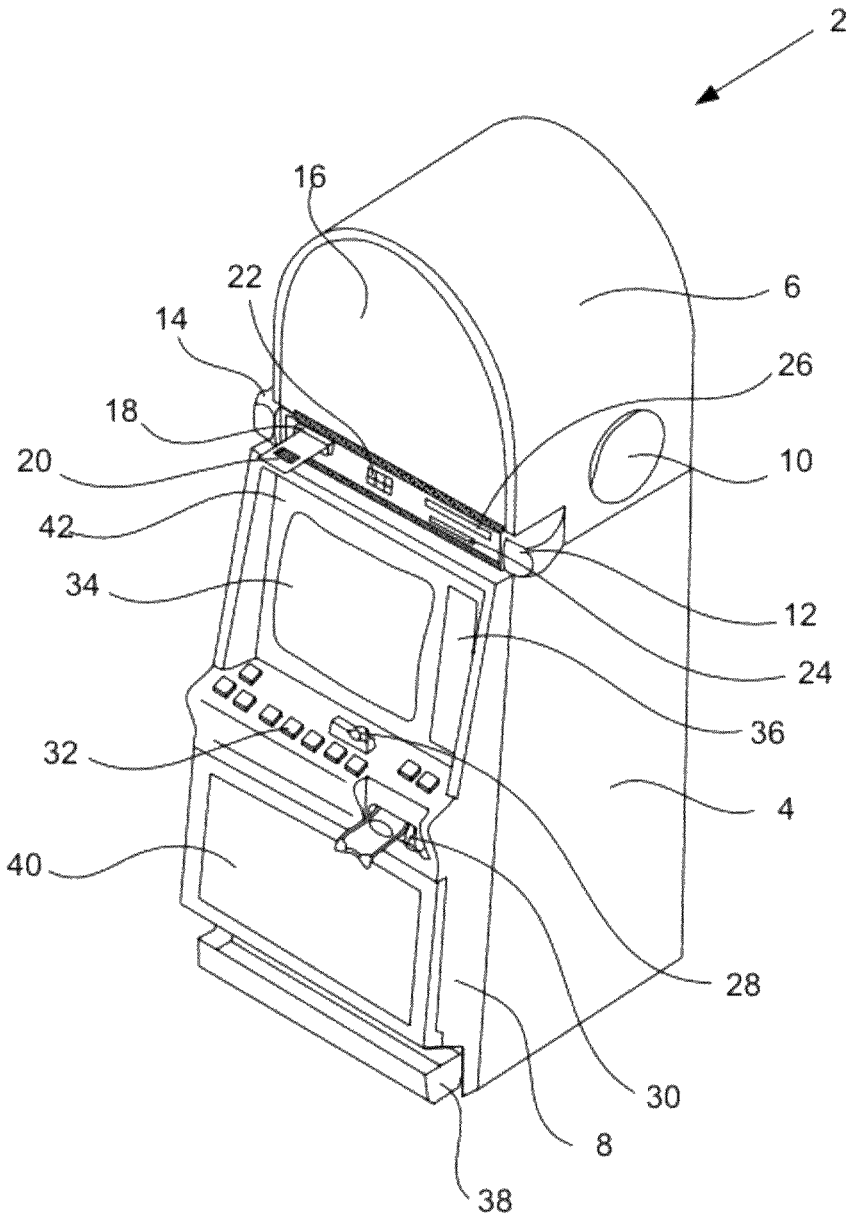
FIG. 1 shows an example of a wager-based gaming machine.

Turning first to FIG. 1, one example of a video gaming machine 2 of the present invention is shown. Machine 2 includes a main cabinet 4, which generally surrounds the machine interior (not shown) and is viewable by users. The main cabinet includes a main door 8 on the front of the machine, which opens to provide access to the interior of the machine. Typically, the main door 8 and/or any other portals which provide access to the interior of the machine utilize a locking mechanism of some sort as a security feature to limit access to the interior of the gaming machine. Also, for further security, various types of sensors may be employed at these entry portals to determine when an access has occurred. For example, the sensor may detect when the door is actuated from a closed position to an open position. Monitoring of these sensors may be carried out by hardware (not shown) located within the main cabinet 4. Attached to the main door are player-input switches 32, a coin acceptor 28, and a bill validator 30, a coin tray 38, a belly glass 40, and a monitor mask 42. The belly glass 40 has a door for maintenance purposes such as changing the glass or lights. This portal may provide indirect access to the interior of the gaming machine. For example, gaps may exist in the cabinet containing the lights for the belly glass.

Viewable through the main door is a video display monitor 34 and an information panel 36. The display monitor 34 will typically be a cathode ray tube, high resolution flat-panel LCD, or other conventional electronically controlled video monitor. The information panel 36 is a back-lit, silk screened glass panel with lettering to indicate general game information including, for example, the number of coins played. The bill validator 30, player-input switches 32, video display monitor 34, and information panel are devices used to play a game on the game machine 2. The devices are controlled by circuitry (not shown) housed inside the main cabinet 4 of the machine 2. Many possible games, including traditional slot games, video slot games, video poker, keno, and lottery, may be provided with gaming machines of this invention.

The gaming machine 2 includes a top box 6, which sits on top of the main cabinet 4. The top box 6 houses a number of devices including speakers 10, 12, 14, a glass panel with display lamps 16, a coupon dispenser 18 which prints barcoded tickets 20, a key pad 22 for entering player tracking information, a florescent display 24 for displaying player tracking information, and a card reader 26 for entering a magnetic striped card containing player tracking information. The top box 6 may contain an entry portal of some type (not shown) to access the devices contained within the top box. This entry portal may contain a lock and sensors for monitoring access to the portal. Further, access to devices within the top box 6 may be monitored. For example, the coupon dispenser 18 may be used to print tickets for game credits. The coupon dispenser (not shown) may contain a door which allows access to the tickets utilized by the coupon dispenser. This entry portal may contain a lock and sensors for monitoring access to the portal.

The devices housed in the top box 6 add features to a game played on the machine 2. During a game, these devices are controlled, in part, by circuitry (not shown) housed within the main cabinet 4 of the machine 2. Further, additional circuitry (not shown) housed within the main cabinet 4 may monitor access to the top box 6 and possibly some devices within the top box. Cables (not shown) are routed from the top box 6 to the interior of the gaming machine to enable these control and monitoring functions.

When a user wishes to play the gaming machine 2, he or she inserts cash through the coin acceptor 28 or bill validator 30. The bill validator 30 or a similar device may read tickets with game credits. The cash or game tokens from the coin acceptor 28 and bill validator 30 may be stored in the interior of the main cabinet 4 in devices including note stackers, drop boxes, and token dispensers. At the start of the game, the player may enter playing tracking information using the card reader 26, the keypad 22, and the florescent display 26. During the game, the player views game information using the video display 34. Usually, during the course of a game, a player is required to make a number of decisions, which affect the outcome of the game. The player makes these choices using the player-input switches 32. During certain game events, the gaming machine 2 may display visual and auditory effects that can be perceived by the player. These effects add to the excitement of a game, which makes a player more likely to continue playing. Auditory effects include various sounds that are projected by the speakers 10, 12, 14. Visual effects include flashing lights, strobing lights or other patterns displayed from lights on the gaming machine 2 including lights behind the front glass 16 on the top box 6 or from lights behind the belly glass 40. After the player has completed a game, the player may receive game tokens from the coin tray 38 or the ticket 20 from the printer 18, which may be used for further games. Further, the player may receive a ticket 20 for food, merchandise, or games from the printer 18.

Figure 2:
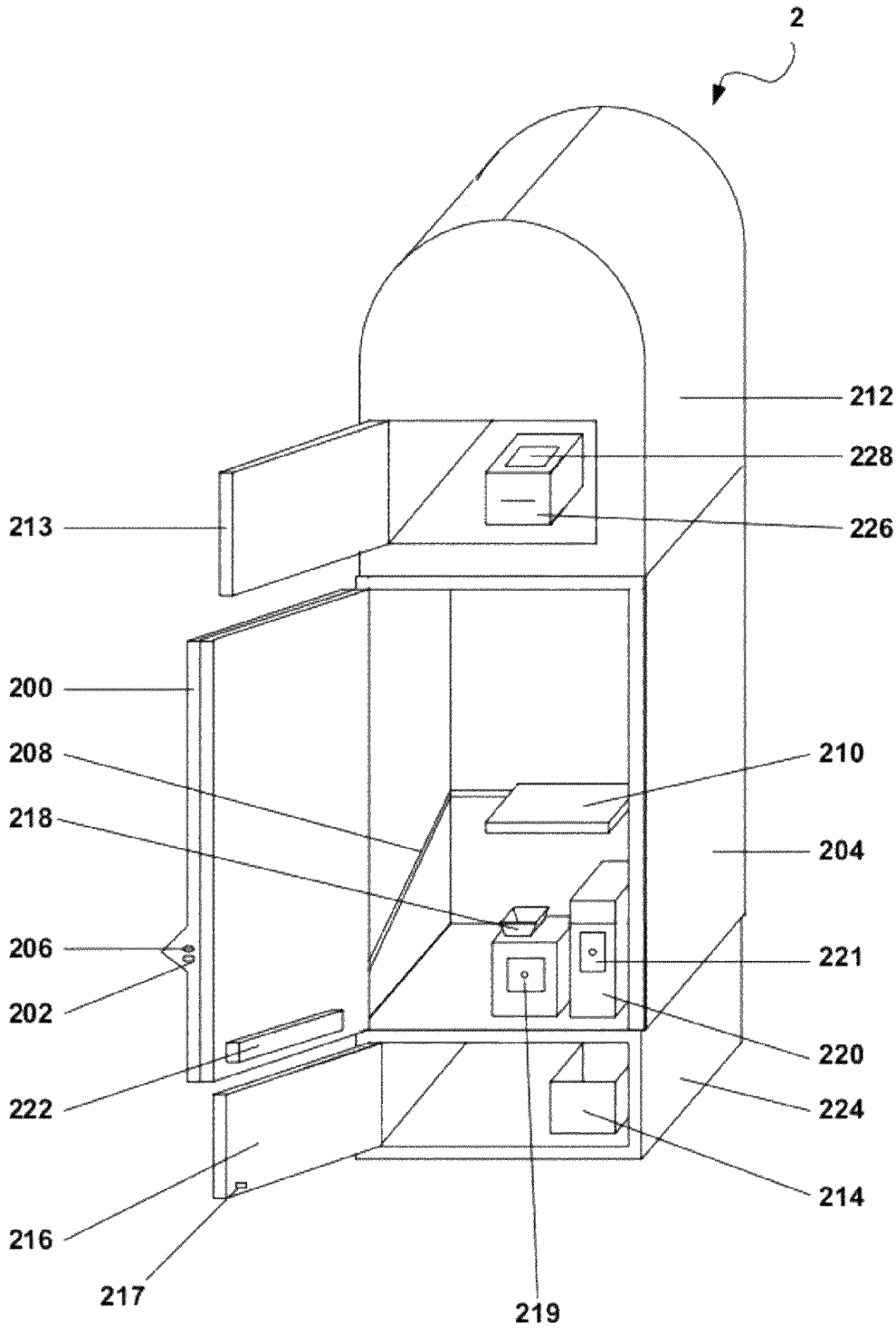
FIG. 2 shows another example of a wager based gaming machine, with doors open to show internal components.

FIG. 2 is a perspective drawing of a gaming machine having a top box 212 with the main door 200 open and the interior of the gaming machine 2 exposed. The main door 200 contains a locking mechanism 202 and a main door sensor 206. Typically, the main door sensor 206 or any type of access sensor may be composed of two parts. Usually, one part of the sensor may be an emitter while the other part of the sensor may be a detector. The emitter and detector act like a switch in a circuit. When the detector is able to receive a signal of some type from the emitter, the sensor circuit is closed and signals may be passed through the circuit. When the detector is unable to receive a signal from the emitter the circuit will be open and a signal may not be passed through the circuit. By monitoring signals passed through the circuit, the status of the circuit, either opened or closed, can be determined. For a door, the sensor emitter and sensor detector may be designed such that signals from the detector can only be received from the emitter when the door is closed. As examples, the main door sensor 206 may be composed of optical sensors which emit and detect light, magnetic sensors which emit and detect a magnetic field, or mechanical sensors which emit and detect current when the two parts of the sensor remain in contact with each other. The main door sensor 206 may have a second part mounted (not shown) on the inside of the main cabinet 204 which enables a closed circuit when the door is closed.

Mounted on the bottom of the main cabinet 204 and inside of the main door 200 may be a note stacker 220 and a token dispenser 218. The note stacker 220 stores bills accepted from the bill validator. The note stacker 220 may contain a door 221 which limits access to the bills stored within the note stacker 220. The note stacker 220 is typically locked or secured in some manner. A sensor may be mounted on the note stacker door 221 to detect when the note stacker door 221 is accessed. Examples of access to the note stacker, which might be detected using a sensor of some type including an optical sensor, magnetic sensor or mechanical sensor, comprise opening a door to access the money stored within the note stacker or removing the note stacker from the gaming machine. In both of these cases, a sensor pair composed of an emitter and detector could be used in conjunction with sensor monitoring circuitry to determine when these events have occurred. The token dispenser 218 accepts coins or tokens from the coin acceptor and pays out winning from the gaming machine. The token dispenser 218 may dispense coins or tokens into the coin tray 222 mounted on the main door 200 of the gaming machine 2. The token dispenser 218 may contain a door 219 which limits access to the tokens or coins stored within the token dispenser 218. Access to the token dispenser 218 may be monitored using a sensor of some type and monitoring circuitry.

The gaming machine 2 is located on top of a drop stand 224. The drop stand 224 may contain a drop stand door 216 and a drop box 214 located within the drop stand 224. The drop box 214 contains the house "take" from the gaming machine. The drop box 214 is typically locked within the drop stand 224 which may be accessed using the drop stand door 216. The drop stand 224 door typically contains a locking mechanism to limit access to the drop box. Drop stand door 216 includes a door sensor 217, which is connected to sensor monitoring circuitry to determine when the drop stand door 216 has been opened. Drop stand door sensor 217 is similar to main door sensor 206.

Processor board 210, which includes a master gaming controller is also located in the interior of the main cabinet 204 of the gaming machine 2. The master gaming controller operates the games played on the gaming machine and the various devices needed to play to the game including the token dispenser 218 and the note stacker 220. Access to the master gaming controller may be limited by one or more doors including the main door 200. Further, the master gaming controller, which may be detached from the gaming machine, may be locked down using an additional device such as a retaining latch for additional security. One or more sensors including optical sensors, magnetic sensors and mechanical sensors may be placed near the master gaming controller to determine when one or more of the following events has occurred: 1) when doors allowing access to the gaming controller have been opened, 2) when a lock down device including the retaining latch for the gaming controller has been actuated, 3) when the gaming controller has been removed from its mounting bracket, 4) when a data port that allows the gaming controller to be programmed has been accessed or 5) when a lock to one of the access mechanisms including the door or the retaining latch has been unengaged. The sensor monitoring circuitry used to monitor the various access sensors may be located on the processor board 210 containing the gaming controller. Such a processor board may form an Electronic Gaming Module (EGM), which integrates various functions of the gaming machine into a single unit to simplify manufacturing and operation of the gaming machine. In the example shown in FIG. 2, board 210 is the EGM, although in other systems, the EGM may include additional components. Information from the various sensors may be carried to the gaming controller via wires contained within a wire harness 208 which go to the various devices and sensors located within the main cabinet 204, main door 200, and top box 212.

The top box 212 may be accessed via a top box access door 213. The top box access door 213 typically contains a locking mechanism to limit access to the top box and a sensor may be connected to sensor monitoring security to determine when the top box access door has been opened. A printer 226 may be located within the top box 212. The printer 226 may print tickets or coupons that may be used for additional game play on the gaming machine 2 or other gaming machines. Thus, the tickets or coupons stored within the printer 226 may be a target of theft. Access to the printer 226 may be limited by a printer access door 228. The printer access door 228 typically contains a locking mechanism to limit access to the printer and a sensor may be connected to sensor monitoring circuitry to determine when the printer access door has been opened.

A primary objective of the sensors and sensor monitoring circuitry may be gaming machine security. During gaming operations, the gaming machine 2 may contain a significant amount of cash stored within the devices including the token dispenser 218, the drop box 214, and the note stacker 220. When the main door 200 or drop stand door 216 of the gaming machine 200 is open, these devices are more accessible and may become a target of theft. Sensors to monitor access to these devices may serve as a deterrent to theft. Further, the master gaming controller 210 determines when a pay-out such as a jackpot should be made for a given game. For gaming machines linked in large networks, the potential jackpots can be very large. Thus, one mode of theft involves manipulating the master gaming controller 210 to falsely reward a pay-out or jackpot. Thus, the sensors that indicate when access to the master gaming controller may have occurred are usually closely monitored using a security monitoring system of some type.

The invention described herein is not limited to the gaming machine configuration shown in FIG. 2. Gaming machines and their associated devices may be physically configured in many different ways. For example, the top box access door 213 may be located on the sides or back of the top box 212 or the drop stand door 216 may be located on the sides or back of the drop stand 224. As another example, a note stacker or other devices potentially requiring a security monitoring system of some type might be located within the top box 212.

Figure 3:
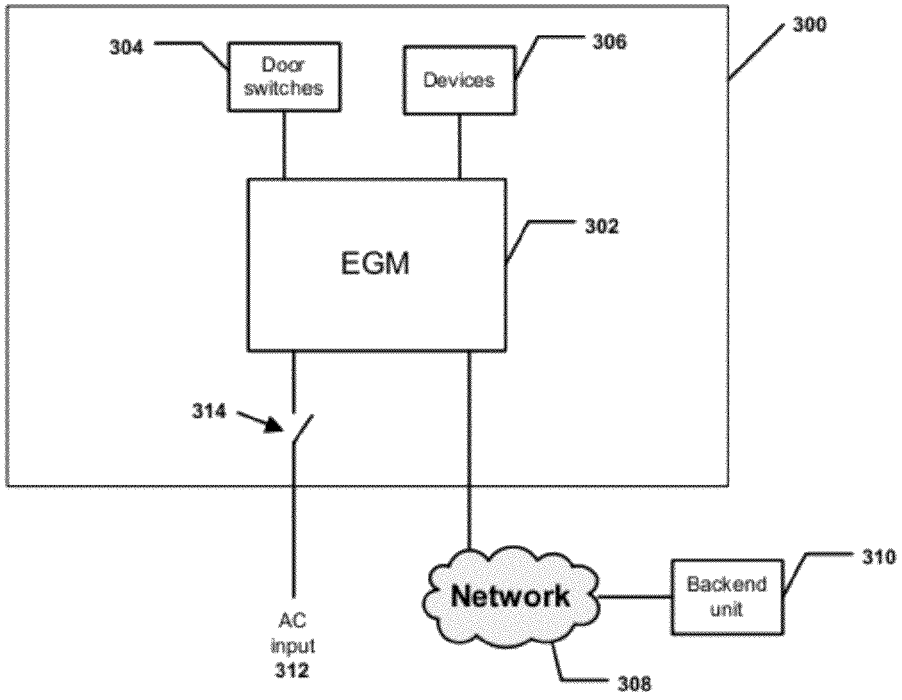
FIG. 3 shows an example of a wager-based gaming machine that is connected to a network.

FIG. 3 shows a simplified block diagram of a networked wager-based gaming machine 300. The gaming machine includes an EGM 302, which in this example is a printed circuit board (PCB) on which a master gaming controller is mounted. The EGM 302 is connected to a plurality of door switches 304 (door switches are represented here by a single box, but it will be understood that actual door switches are separate units that are distributed at different locations). The EGM 302 is also shown as being connected to devices 306 (represented by a single box, although most systems have several devices connected to the EGM, including devices such as lights, coupon dispensers, card readers, bill validators, coin acceptors, coin hoppers, display panels, key pads, and gaming controllers). One such device that is important from a security perspective is an identification device to allow an employee to identify themselves to gain access to the gaming system. Such a device may be a card reader, an RFID reader, a keypad or other suitable device. Prior to opening a door, an employee may be able to identify themselves using such a device so that an alarm is not sent when a door open switch detects a door opening. Such an identification device may be integrated with other devices. For example, a player tracking unit that reads a player's card or RFID to determine the player's identity may also identify an employee. Alternatively, an employee identification device may be a separate dedicated device.

The EGM 302 of FIG. 3 is connected to a data network 308. Such a network connection to a gaming machine provides many advantages. In particular, a gaming machine may be reconfigured over a network so that games can be upgraded or replaced without physically accessing the gaming machine. This is particularly advantageous where a casino for example has a large number of gaming machines that need to be reconfigured. Whereas physically accessing each gaming machine can be time-consuming and may carry some risk of interference with gaming machines when they are opened, accessing gaming machines over a network can be faster and more secure. A backend unit 310 is connected to the network and may control and monitor aspects of the operation of the gaming machine. The backend unit 310 may include functions such a player tracking and certain security functions. In particular, any security related event, such as activation of a door switch, or other unauthorized access would generally be reported to the backend unit 310, where a determination can be made as to how to deal with the event. For example, an alarm may be sent to security staff who can direct cameras to the gaming machine where the event is occurring.

The EGM 302 is also connected to a source of electrical power (AC input) 312, which is typically an electrical outlet located under or behind the gaming machine. A switch 314 is provided to power down the EGM 302. Typically, such a switch is located where it is only accessible to authorized employees. One drawback of the system of FIG. 3 is that when the EGM 302 is powered down by turning the switch 314 off, security functions are no longer provided by the EGM 302. Also, when the EGM 302 is powered down, the network connection to the EGM is unavailable so that no security information is sent to the backend unit 310. This means that no remote monitoring of the gaming machine 300 is performed when the EGM 302 is switched off.

Figure 4:
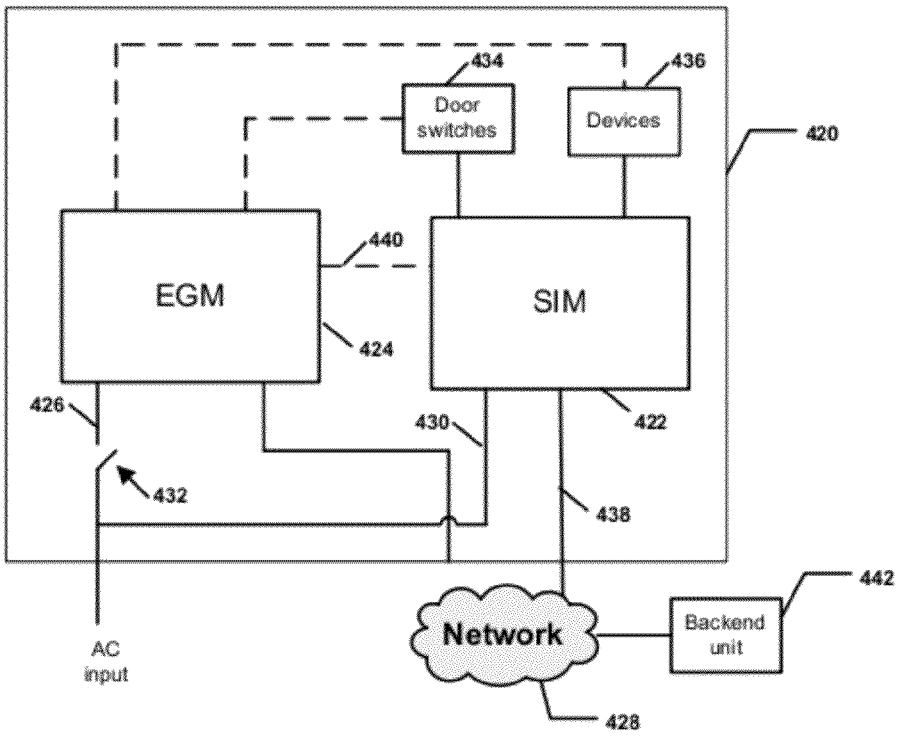
FIG. 4 shows an example of a wager-based gaming machine that has a security interface module that monitors door switches and devices, and which has an independent network connection.

FIG. 4 shows an alternative gaming machine 420 in which a Security Interface Module (SIM) 422 is provided. An EGM 424 is provided as before, with a switched AC input 426, and a network connection to network 428. However, here the SIM 422 has an unswitched AC input 430. That is, the power to the SIM 422 is independent of the switch 432 controlling power to the EGM 424. Thus, even when the EGM 424 is powered down, the SIM 422 remains powered up. The SIM 422 can maintain security even when power is switched off to the EGM 424. As FIG. 4 shows, the door switches 434 and devices 436 are connected to the SIM 422, which monitors door switches and devices in a similar manner to the EGM. The SIM 422 also has its own network connection 438 so that it can communicate with the backend unit 442 (via the network) independently of the EGM.

In some examples, the SIM 422 performs security functions at all times (whether the EGM 424 is powered up or not), in which case the EGM 424 may not even be connected to door switches 434 and some devices 436 (dotted lines indicate connections that may or may not be present, depending on particular implementation). In other examples, the EGM 424 performs security functions when it is powered up, and the SIM 422 only performs security functions when the EGM loses power. In this case, the SIM 422 must be aware of the status of the EGM 424 (as either powered up or powered down). The SIM 422 can become aware of the status of the EGM 424 by a dedicated connection 440 to the EGM by which the SIM monitors the EGM. Alternatively, the backend unit 442 can detect powering down of the EGM 424 and can alert the SIM 422 that the EGM 424 is powered down. In response, the SIM 422 starts to perform security functions.

In yet another arrangement, monitoring of security functions may be performed by both the EGM 424 and the SIM 422 in parallel. Both the EGM 424 and the SIM 422 may report back to the backend unit 442, so that there is redundancy provided in monitoring, making it harder for anyone to interfere with the security functions. Input received by the backend unit 442 from the EGM 424 and the SIM 422 may be compared to determine if there is any discrepancy. If there is a discrepancy between information received from the EGM 424 and the SIM 422, then appropriate action may be taken (e.g. an alarm may be sent). In other examples, such redundancy may be taken further, with separate networks provided for the EGM and the SIM.

Figure 5:
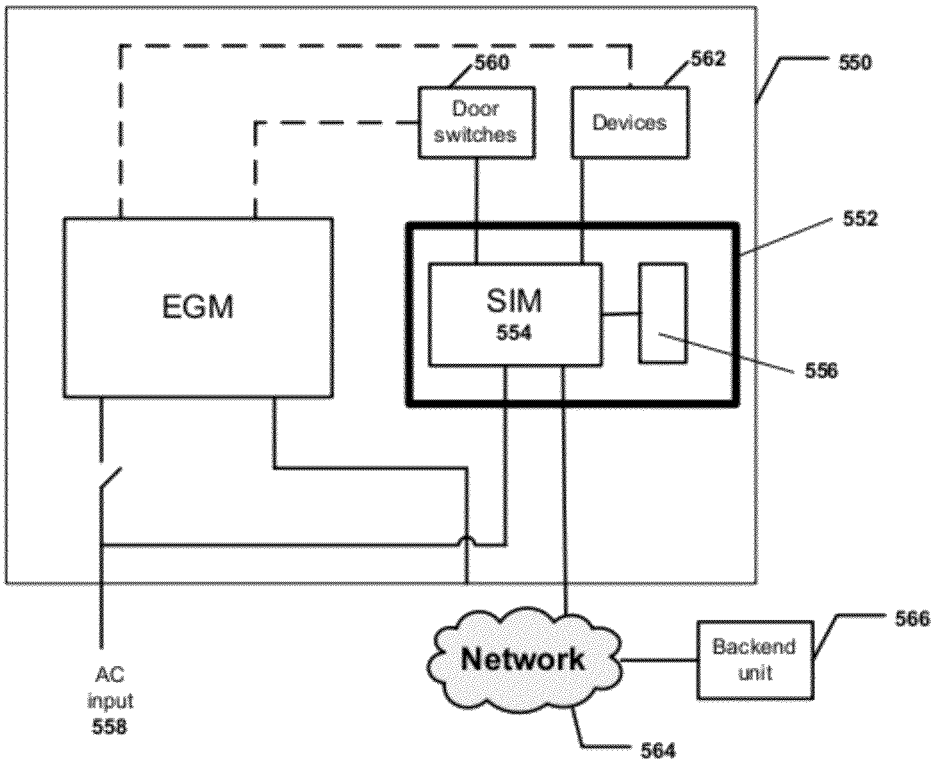
FIG. 5 shows an example of a wager-based gaming machine that includes a security interface module protected by a secure enclosure.

FIG. 5 shows another gaming machine 550, which is similar to the gaming machine 420 of FIG. 4, but with a secure enclosure 552 provided for the SIM 554. The secure enclosure 552 may be for example a locked steel box, which makes access to the SIM 554 very difficult for a criminal. Included in the secure enclosure 552 is a battery 556, which provides power independently of the AC input 558. In this case, even if power is removed to the entire gaming machine 550, the SIM 554 continues to operate and monitor door switches 560 and devices 562. Network 564 may also have some emergency power supplies so that the network 564 continues to function without power and the backend unit 566 can continue to monitor gaming machines when power is removed.

Figure 6:
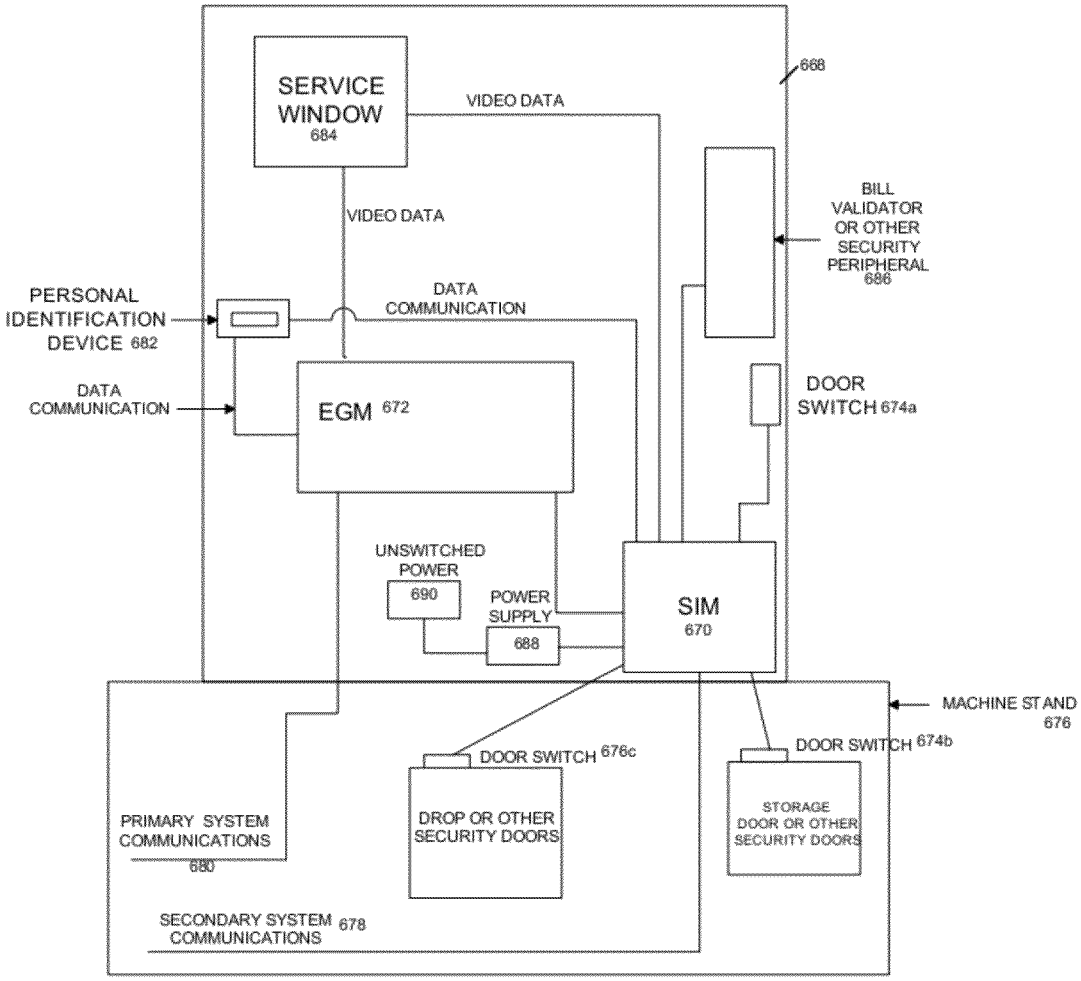
FIG. 6 shows an example of a wager based gaming machine with multiple components connected to a security interface module.

FIG. 6 shows a more detailed view of a gaming machine 668 that includes a SIM 670 and an EGM 672 (which may be in a secure enclosure with its own power supply). In particular, FIG. 6 shows the SIM 670 located in the gaming machine 668, with connection to door switches 674*a-c* in both the gaming machine 668 itself and in the machine stand 676 on which the gaming machine is positioned. While the SIM 670 is shown as being located in the gaming machine 668, in other examples, the SIM may be located in the machine stand or in a top box, or in some other location. FIG. 6 also shows that the SIM 670 is connected to a communication network through a secondary system communications link 678 (the EGM is connected through a primary system communications link 680). This means that the SIM 670 can communicate with a backend unit independently of the EGM 672. The SIM 670 also has connections to various devices including a personal identification device 682, a service window 684, and a bill validator 686 so that the SIM can monitor these devices for any security events. The SIM 670 also has a direct connection to the EGM 672 so that the SIM can monitor the status of the EGM and can detect when the EGM changes between powered-up and powered-down conditions. Some devices are connected to both the EGM 672 and the SIM 670 (e.g. personal identification device 682, and service window 684) and the SIM may perform monitoring of these devices when the EGM is powered down. The SIM 670 is connected to a power supply 688 that receives power from an unswitched power source 690 so that the SIM does not lose power when the power to the gaming machine is switched off.

Figure 7:
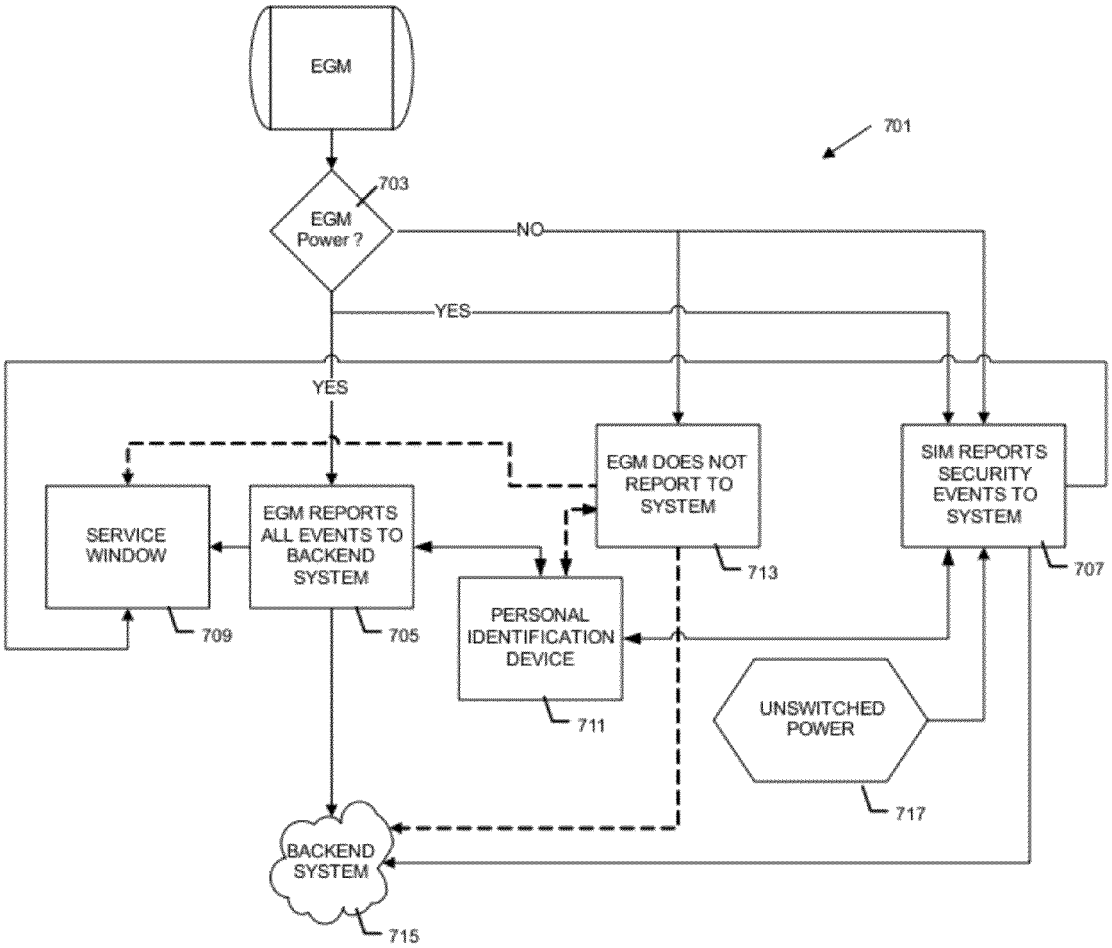
FIG. 7 is a flowchart showing an example of operation of a security interface module in a wager-based gaming machine.

FIG. 7 shows a flowchart 701 which shows operation of a gaming machine according to an embodiment. A determination is made 703 as to whether the EGM has power or not. This determination can be made by the SIM, by the backend system, or by another unit. If it is determined that the EGM has power then the EGM reports all events to the backend system 705, and the SIM reports security events to the backend system 707. The EGM may provide an output to the service window 709 that indicates that it has power and the SIM may also provide an output to the service window 709 indicating that it is operational. Both the EGM and SIM communicate with the personal identification device 711 in this case, so that both modules monitor the identity of people interacting with the gaming machine. If it is determined that the EGM does not have power, the EGM does not report to the backend system 713, and a signal may be passed to the backend system 715 indicating that the EGM is unavailable. The SIM alone reports security events 707 to the backend system 715 in this case. The SIM receives power from an unswitched power source 717 so that it continues to receive power even when the EGM is powered down.

Techniques and mechanisms of embodiments described herein may sometimes be described in singular form for clarity. However, it should be noted that particular embodiments include multiple iterations of a technique or multiple instantiations of a mechanism unless noted otherwise.

Although several preferred embodiments of this invention have been described in detail herein with reference to the accompanying drawings, it is to be understood that the invention is not limited to these precise embodiments, and that various changes and modifications may be effected therein by one skilled in the art without departing from the scope of spirit of the invention as defined in the appended claims.

What is claimed is:

1. A method of operating a networked wager-based gaming machine comprising:

performing one or more security functions in an electronic gaming module, the electronic gaming module connected to a data network by a first data connection;

monitoring power provided to the electronic gaming module; and in response to detecting a loss of power to the electronic gaming module, performing the one or more security functions in a security interface module, the security interface module connected to the data network by a second data connection, the security interface module receiving power separately from the electronic gaming module;

wherein, when the power is switched on to the wager-based gaming machine, the electronic gaming module and the security interface module perform the one or more security functions together.

2. The method of claim 1 wherein the one or more security functions include monitoring door switches.

3. The method of claim 1 wherein the one or more security functions include controlling employee access to the wager-based gaming machine when the power switch is off.

4. The method of claim 1 further comprising monitoring data provided by the electronic gaming module over the first connection, and data provided by the security interface module over the second connection, to identify discrepancies, and issue an alert in response to identification of a discrepancy.

5. The method of claim 1 further comprising reporting an unauthorized access to a component of the networked wager-based gaming machine to a backend unit through the second data connection.

6. A method of operating a networked wager-based gaming machine comprising:

performing one or more security functions in an electronic gaming module, the electronic gaming module connected to a data network by a first data connection;

receiving an alert from an external system indicating a loss of power of the electronic gaming module at a security interface module; and in response to receiving the alert of the loss of power to the electronic gaming module, performing the one or more security functions in a security interface module, the security interface module connected to the data network by a second data connection, the security interface module receiving power separately from the electronic gaming module;

wherein, when the power is switched on to the wager-based gaming machine, the electronic gaming module and the security interface module perform the one or more security functions together.

7. The method of claim 6 wherein the one or more security functions include monitoring door switches.

8. The method of claim 6 wherein the one or more security functions include controlling employee access to the wager-based gaming machine when the power switch is off.

9. The method of claim 6 wherein the electronic gaming module performs the one or more security functions when power is switched on to the electronic gaming module.

10. The method of claim 6 further comprising monitoring data provided by the electronic gaming module over the first connection, and data provided by the security interface module over the second connection, to identify discrepancies, and issue an alert in response to identification of a discrepancy.

11. A method of operating a networked wager-based gaming machine comprising:

powering an electronic gaming module with a first electrical power source;

performing one or more security functions in an electronic gaming module, the electronic gaming module connected to a data network by a first data connection;

monitoring power provided to the electronic gaming module;

powering a security interface module with a second power source; and in response to detecting a loss of power to the electrical gaming module, performing the one or more security functions in the security interface module, the security interface module connected to the data network by a second data connection;

wherein, when the power is switched on to the wager-based gaming machine, the electronic gaming module and the security interface module perform the one or more security functions together.

12. The method of claim 11 wherein the one or more security functions include monitoring door switches.

13. The method of claim 11 wherein the one or more security functions include controlling employee access to the wager-based gaming machine when the power switch is off.

14. The method of claim 11 wherein the electronic gaming module performs the one or more security functions when power is switched on to the electronic gaming module.

15. The method of claim 11 further comprising monitoring data provided by the electronic gaming module over the first connection, and data provided by the security interface module over the second connection, to identify discrepancies, and issue an alert in response to identification of a discrepancy.

16. The method of claim 11 wherein the second power source includes a battery.

17. The method of claim 11 further comprising reporting an unauthorized access to a component of the networked wager-based gaming machine to a backend unit through the second data connection.

* * * * *